US009656831B2

(12) United States Patent
Tsunemine et al.

(10) Patent No.: US 9,656,831 B2
(45) Date of Patent: May 23, 2017

(54) TRAVERSE DEVICE AND TRAVERSE METHOD

(71) Applicant: TOKUSEN KOGYO CO., LTD., Ono, Hyogo (JP)

(72) Inventors: Setsuo Tsunemine, Ono (JP); Hiroshi Inoue, Ono (JP)

(73) Assignee: TOKUSEN KOGYO CO., LTD., Ono, Hyogo (JP)

( * ) Notice: Subject to any disclaimer, the term of this patent is extended or adjusted under 35 U.S.C. 154(b) by 183 days.

(21) Appl. No.: 14/409,050

(22) PCT Filed: Sep. 20, 2012

(86) PCT No.: PCT/JP2012/074053

§ 371 (c)(1),
(2) Date: Dec. 18, 2014

(87) PCT Pub. No.: WO2013/190716

PCT Pub. Date: Dec. 27, 2013

(65) Prior Publication Data

US 2015/0321874 A1 Nov. 12, 2015

(30) Foreign Application Priority Data

Jun. 20, 2012 (JP) ..... 2012-139148

(51) Int. Cl.
*B65H 54/28* (2006.01)
*B65H 54/36* (2006.01)

(52) U.S. Cl.
CPC ..... *B65H 54/2836* (2013.01); *B65H 54/2803* (2013.01); *B65H 54/2848* (2013.01); *B65H 54/36* (2013.01); *B65H 2701/36* (2013.01)

(58) Field of Classification Search
CPC ..... B65H 54/2833; B65H 54/2818; B65H 54/2803; B65H 54/28; B65H 54/2848;
(Continued)

(56) References Cited

FOREIGN PATENT DOCUMENTS

JP 54118954 A 9/1979
JP 56082768 A 6/1981
(Continued)

OTHER PUBLICATIONS

Machine Translation of JP56-082768 A, Jul. 6, 1981.*
Machine Translation of JP 54-118954 A, Sep. 14, 1979.*

*Primary Examiner* — William E Dondero
(74) *Attorney, Agent, or Firm* — Browdy and Neimark, PLLC

(57) ABSTRACT

The invention makes it possible to perform regular winding of a wire easily, inexpensively, and reliably. During traversing a winding position in the reel axis direction, while a guide roller 2 is held at a position where the distance (D) from the wound surface on the outer circumference of a reel body 1*a* is in a range of more than 0 mm to 30 mm or less, it is kept at an orientation where a roller radial center line P is perpendicular to a reel axis R at a position apart from a border with a reel flange 1*b*, and gradually inclined, with movement of a reel 1 in the reel axis direction, in a direction in which the roller outer edge goes away from the reel flange 1*b* ahead in the traverse direction on the side apart from the reel body 1*a* relative to a rotation center C, as a fulcrum, located near the outer edge on the side near the outer circumference of the body of the reel 1 at a position of the border of the reel flange 1*b*.

6 Claims, 3 Drawing Sheets

(58) Field of Classification Search
CPC B65H 54/325; B65H 57/006; B65H 2701/36; B65H 2404/741; B65H 2404/742; B65H 54/2821; B65H 54/283; B65H 54/2836
See application file for complete search history.

(56) References Cited

FOREIGN PATENT DOCUMENTS

| | | | |
|---|---|---|---|
| JP | 2001180866 | A | 7/2001 |
| JP | 2011210616 | A | 10/2011 |

* cited by examiner

TRAVERSE DEVICE AND TRAVERSE METHOD

TECHNICAL FIELD

The present invention relates to a traverse device and a traverse method for winding wires (wire materials) including metal wires such as steel cords, bead wires, and wires for piston rings, coated wires such as electric cables, and other wires such as ropes on a reel by regular winding.

BACKGROUND ART

As a method for winding a wire on a reel, the following method is conventionally known: a wire is guided to a reel body via a guide roller (traverse guide roller) placed at a distance radially from the reel body so as not to interfere with a reel flange, and wound by rotating the reel while moving the reel or the guide roller in the reel axis direction to move (traverse) the winding position. In this method, however, since there is a considerable distance between the wound surface on the outer circumference of the reel body and the guide roller, leeway occurs, resulting in that a deviation occurs between the movement of the winding position of the wire on the reel body and the movement of the reel or the guide roller. In particular, traverse adjustment at the reversal of the movement at both ends of the reel body is not easy, and thus the wound surface cannot be controlled. For this reason, when regular winding of a wire is attempted by this method, an intended wound surface is not obtained, but the wire piles up. Once it piles up to a given extent, the pile collapses, and this causes entanglement. Also, when cross winding is performed by this method, where the winding pitch is large, the influence of the leeway caused by the large distance between the wound surface and the guide roller on the finishing of the wound surface is comparatively small. In this case, however, since the reeled-out wire digs into space between lines of the wire, the wire tends to acquire flaws. Also, the winding thickness becomes large, forming voids within the wound wire. The articles tend to collapse during preparation for shipping, and this also causes entanglement and flaws.

When the distance between the wound surface and the guide roller is large, it is not possible to control the wound surface, failing to perform regular winding, as described above. In view of this, the following method is also considered: using a large-diameter disc-shaped guide roller, the outer edge of the roller is placed as close to the wound surface as possible, to wind the wire. According to this method, by bringing the roller outer edge as close to the wound surface as possible, the movement of the winding position of the wire on the reel body can be made to roughly coincide with the movement of the reel or the guide roller. In this method, however, when it is intended to wind the wire up to a reel flange border, the guide roller may collide against the reel flange because the reel flange has variations in machining accuracy and deformation. The reel deforms after many times of use. Also, since the reel is put into an oven together with the wire during annealing, deformation of the reel is unavoidable. For this reason, to avoid the collision, the setting of the traverse must be adjusted every winding task, and this takes time. If an allowance is given to the setting to avoid the collision, the approach to the flange border becomes loose, resulting in a shape of drum winding that is quite different from regular winding.

Also, as a method of permitting the wire to be wound up to the reel flange border while bringing the roller outer edge close to the wound surface, a method is proposed where the guide roller is placed so as to be inclinable in the reel axis direction relative to a rotational axis, as the rotation center, located at the roller outer edge on the side apart from the outer circumference of the reel body. At the time of traverse reversal near the flange border of the reel body at either end, the movement of the reel in the axis direction is stopped, and, while the guide roller is angled and inclined so that the roller outer edge comes close to the reel flange border on the reel side, the reel is rotated to wind the wire on the reel body at the flange border. At a midpoint position of the reel body, while the reel is moved continuously in the axis direction at a constant speed, the guide roller is angled so as to wind the wire on the reel body by one rotation at a time (see Patent Document 1, for example). According to this method, the guide roller is inclined at both ends of the reel body to enable winding of the wire up to the flange borders, and thus regular winding can be performed. In this method, however, not only at the time of traverse reversal, but also at the midpoint position of the reel body, it is necessary to move the rotational axis of the guide roller forward or backward with respect to the reel body, every time the guide roller is angled, in response to the inclination so as to ensure that the guide roller is not apart from the reel, and this makes the control complicated. Also, when the guide roller is inclined, the pitch of the traverse changes when the reel moves at a constant speed, for example. For this reason, in order to keep the pitch of the traverse constant, pitch adjustment is necessary for the reel or the guide roller every time the guide roller is angled. This control is complicated and costly.

The following method has also been considered. As in the above method, the guide roller is placed so as to be inclinable in the reel axis direction relative to the rotational axis, as the rotation center, located at the roller outer edge on the side apart from the outer circumference of the reel body, and the roller outer edge is inclined to be close to the reel flange located ahead in the traverse direction on the side near the reel body. In this method, however, the inclining direction of the guide roller is switched to the opposite direction at the midpoint position of the reel body, and the guide roller is inclined at all times except for this switching time. With the guide roller kept inclined in this way, while the reel, for example, is moved in the axis direction for traverse, the reel is rotated to wind the wire thereon. According to this method, where traverse is performed with the guide roller kept inclined, it is unnecessary to move the guide roller forward or backward in response to the inclination of the guide roller. Also, since the inclining direction of the guide roller does not change during one back and forth traverse motion, control of the pitch adjustment is comparatively easy. However, in this case, also, the inclining direction of the guide roller is switched for every back and forth traverse motion, and at this switching, the guide roller rotates around the rotation center located at the roller outer edge on the side apart from the outer circumference of the reel body. Therefore, the winding position of the wire to be wound on the reel body is slightly deviated in the reel axis direction, changing the traverse pitch. For this reason, in order to keep the pitch constant, control of moving the reel or the guide roller in the reel axis direction is necessary, which is not easy.

To address the above problem, the present applicant focused attention on a traverse device and method as follows, and filed an application for a patent previously (Japanese Patent Application No. 2011-210616). As in the above methods, the guide roller is made inclinable in the reel axis direction so that the roller outer edge is inclined in a direction toward the reel flange located ahead in the traverse direction on the side near the reel body. In this case, however, the rotation center for the inclination of the guide roller is located at the outer edge on the side near the outer circumference of the reel body. The inclining direction of the guide roller is switched at the midpoint position of the reel body, and the traverse is performed with the guide roller kept inclined. Using this technique, the winding position is hardly deviated at the switching of the inclining direction, and thus the pitch of the traverse can be kept roughly constant.

PRIOR ART DOCUMENT

Patent Document

[Patent Document 1] JP 2001-180866A

SUMMARY OF INVENTION

Technical Problem

As described above, in the prior art, since the distance between the wound surface on the reel and the guide roller is large, the wound surface cannot be controlled. Also, since the guide roller may possibly collide against the reel flanges at the time of traverse reversal, regular winding of a wire cannot be performed, and the wire tends to have entanglement and flaws at the flange borders. In the method of winding the wire up to each flange border while angling the guide roller, it is necessary to provide the control of moving the guide roller toward or away from the reel body every time the guide roller is angled, and this control is complicated and costly. Also, in the method of inclining the guide roller at all times and switching the inclining direction at the midpoint position of the traverse, the rotation center for the inclination of the guide roller is set at the outer edge of the guide roller on the side near the outer circumference of the reel body. This makes it possible to prevent or reduce variations in traverse pitch due to a deviation of the winding position, and thus achieve regular winding of the wire under a simple control. In this method, however, the inclining direction of the guide roller must be switched to the opposite direction immediately at the midpoint position of the traverse, causing a large change in the inclination of the guide roller at this switching. This raises a possibility that the wire may be deviated in the width direction of the groove of the guide roller, and the wound surface may be uneven. Moreover, depending on the working conditions, the wire may come off from the guide roller.

An object of the invention is providing a traverse device and a traverse method capable of performing regular winding of a wire easily, inexpensively, and reliably.

Solution to Problem

A traverse device according to the invention is a traverse device for winding a wire, fed via a guide roller having a guide groove on its outer circumference, onto a reel by regular winding while moving a winding position of the wire with respect to the reel in a reel axis direction with movement of at least one of the guide roller and the reel, wherein the guide roller is placed near an outer circumference of a body of the reel, and is kept at an orientation where a roller radial center line crossing a reel axis is perpendicular to the reel axis at a position apart from a reel flange border, and inclined in a direction in which a roller outer edge goes away from a reel flange ahead in a traverse direction on the side apart from the reel body relative to a rotation center, as a fulcrum, located near the outer edge on the side near the outer circumference of the reel body at a position of the reel flange border.

In the above traverse device, the distance between the wound surface on the reel and the guide roller can be reduced over the entire area in the reel axis direction including the reel flange borders, and thus the wound surface can be controlled. Also, since the guide roller keeps its perpendicular orientation in an area other than the reel flange borders, the pitch of traverse can be held constant over a wide area in the reel axis direction. At the reel flange borders, by inclining the guide roller, the wire can be wound up to the ends of the reel body while avoiding contact with the reel flanges. At this time, by inclining the guide roller relative to the rotation center, as the fulcrum, located near the roller outer edge on the side near the outer circumference of the reel body, the wire is prevented from largely deviating in the width direction of the guide groove, and thus the traverse pitch can be kept roughly constant. The motion of the guide roller of inclining at the reel flange borders is a motion from the perpendicular state toward the inclined state, or the reverse of this, not involving an immediate large inclination to the opposite direction. Therefore, it is possible to prevent or reduce deviation of the wire in the width direction of the groove of the guide roller, thereby preventing or reducing unevenness of the wound surface, and also preventing or reducing the chance of the wire coming off the guide roller. Also, even if there are variations in machining precision, deformation due to repeated use, deformation at the time of heat treatment of the wire, etc. in the reel flange, the guide roller can be kept from contact with the reel flange. Thus, occurrence of entanglement and flaws due to stacking of the wire can be prevented, and even square wires and other oddly-formed wires such as I-shaped wires can be subjected to regular winding easily, inexpensively, and reliably.

In the above traverse device, in particular, the guide roller may be placed near an outer circumference of a body of the reel, and be kept at an orientation where a roller radial center line crossing a reel axis is perpendicular to the reel axis at a position where the distance between a roller end face and a reel flange exceeds a first distance in the reel axis direction, and gradually inclined, with the movement in the reel axis direction, in a direction in which a roller outer edge goes away from a reel flange ahead in a traverse direction on the side apart from the reel body relative to a rotation center, as a fulcrum, located near the outer edge on the side near the outer circumference of the reel body at a position where the distance between the roller end face and the reel flange does not exceed the first distance in the reel axis direction, so that the inclined angle of the roller radial center line to a direction perpendicular to the reel axis may become maximum at a position where the distance between the roller end face and the reel flange is a second distance that is smaller than the first distance in the reel axis direction. With this configuration, regular winding can be performed easily.

In the above traverse device, the first distance may be 10 to 50 mm, and the second distance may be 1 to 10 mm. By setting the first distance and the second distance as described above, regular winding can be performed smoothly and reliably. If the first distance is less than 10 mm, the inclining motion of the guide roller will be so sharp between the first position and the second position that the wire may possibly come off the guide roller. If the first distance exceeds 50 mm, the area where the guide roller is inclined will be unnecessarily large, increasing the possibility that the winding position may be deviated. If the second distance is less than 1 mm, there is a high possibility that the guide roller may come into contact with the reel flange in the case that the reel has undergone a deformation. Note however that, when the reel has undergone no deformation, it is preferable that the second distance be closer to 0 mm. If the second distance exceeds 10 mm, the state of the inclination of the guide roller being maximum will last long, causing a possibility that the control of the wound surface may become loose at the time of traverse reversal.

In the above traverse device, the distance between the roller outer edge and the wound surface on the outer circumference of the reel body may be in a range of more than 0 mm to 30 mm or less. With this setting, through accurate control of the winding position over a wide area in the reel axis direction, regular winding as intended can be performed. If the distance between the roller outer edge and the wound surface on the outer circumference of the reel body exceeds 30 mm, there is a possibility of failing to control the winding position accurately. It is advisable that this distance be reduced to a minimum as far as the roller outer edge is prevented from hitting the wound surface.

In the above traverse device, the width size of the guide groove of the guide roller may be the width size of the wire plus 0.1 to 0.50 mm. By setting the width size of the guide groove as described above, it is possible to prevent deviation of the wire while securing leeway in the groove width direction. Thus, through accurate control of the winding position, regular winding as intended can be performed. If the width size of the guide groove is less than the width size of the wire plus 0.1 mm, the leeway will decrease, and thus feeding of the wire will become less smooth, raising a possibility of occurrence of a flaw. If the width size of the guide groove exceeds the width size of the wire plus 0.50 mm, the wire will deviate in the width direction of the guide groove, raising a possibility of failing to control the winding position accurately.

A traverse method according to the invention uses the traverse device described above, and includes placing the guide roller near an outer circumference of a body of the reel, and keeping the guide roller at an orientation where a roller radial center line crossing a reel axis is perpendicular to the reel axis at a position apart from a reel flange border, and inclining the guide roller in a direction in which a roller outer edge goes away from a reel flange ahead in a traverse direction on the side apart from the reel body relative to a rotation center, as a fulcrum, located near the outer edge on the side near the outer circumference of the reel body at a position of the reel flange border. By this method, regular winding can be performed easily, inexpensively, and reliably.

Advantageous Effects of Invention

As is apparent from the description described above, according to the invention, the distance between the wound surface on the reel and the guide roller can be reduced over the entire area in the reel axis direction including the reel flange borders. Also, the guide roller can be kept in its perpendicular position over a wide area, whereby the control of the wound surface is easy. In addition, by inclining the guide roller at the reel flange borders, the wire can be wound up to the ends of the reel body. At this time, it is possible to prevent or reduce deviation of the wire in the width direction of the groove of the guide roller, thereby preventing or reducing unevenness of the wound surface, and also preventing or reducing the chance of the wire coming off the guide roller. Even if there are variations in machining precision, deformation due to repeated use, deformation at the time of heat treatment of the wire, etc. in the reel flange, the guide roller can be kept from contact with the reel flange. Thus, occurrence of entanglement and flaws due to stacking of the wire can be prevented, and even square wires and other oddly-formed wires such as I-shaped wires can be subjected to regular winding easily, inexpensively, and reliably.

DESCRIPTION OF EMBODIMENTS

Figure 1:
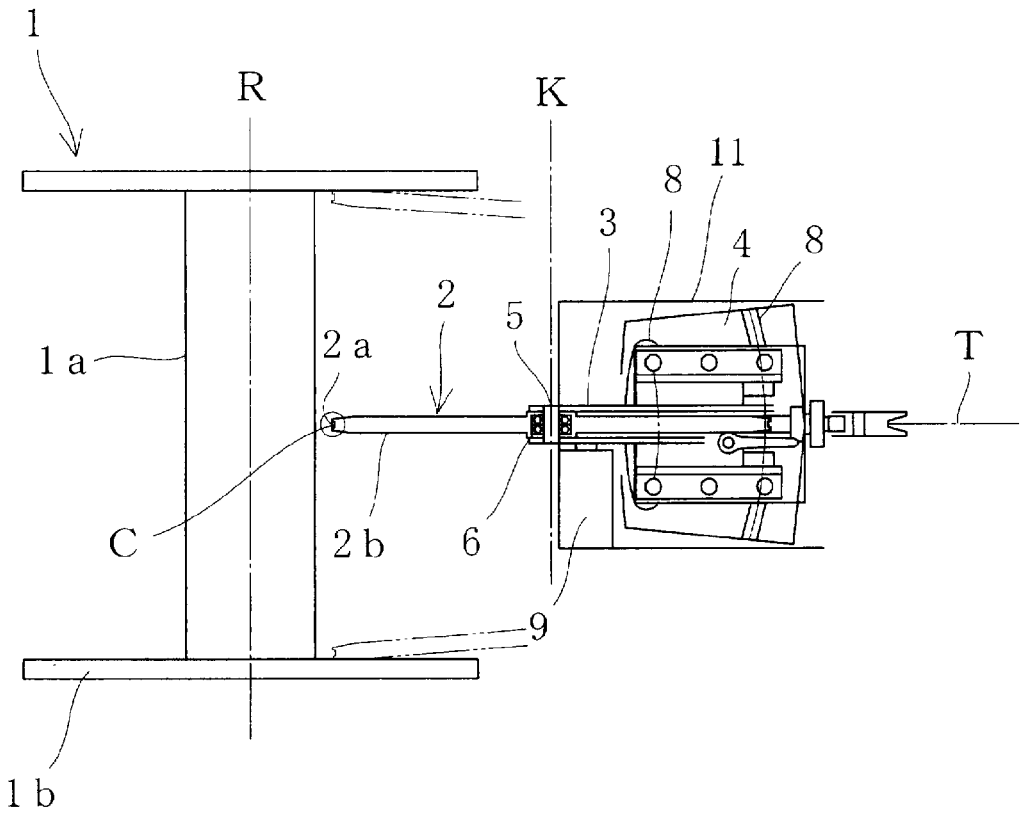
FIG. 1 is a plan view showing a main part of a traverse device of an embodiment of the invention.
Figure 2:
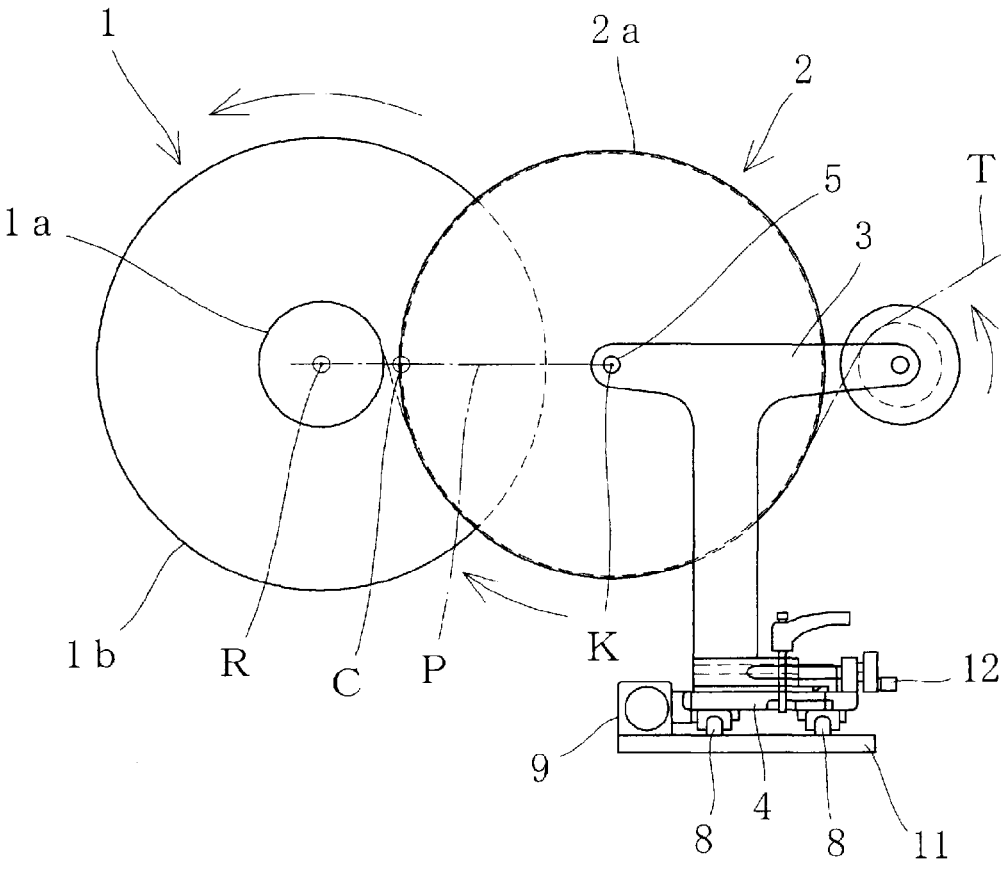
FIG. 2 is a side view showing the main part of the traverse device of the embodiment of the invention.

FIGS. 1 and 2 show a configuration of a main part of a traverse device of an embodiment of the invention. In FIGS. 1 and 2, the reference numeral 1 denotes a reel (take-up reel), 1*a* denotes a reel body, 1*b* denotes a reel flange, 2 denotes a guide roller (traverse guide roller), 2*a* denotes a guide groove on the outer circumference of the guide roller, 3 denotes a support arm that supports the guide roller, and 4 denotes a support block that supports the support arm 3.

The guide roller 2 is rotatably supported, via a bearing 6, by a roller shaft 5 that is supported by the support arm 3, and placed at a position where the outer edge of the roller comes close to the outer circumference of the reel body 1*a* in the space between the reel flanges 1*b* on both sides of the reel 1, entering deep inside the reel flanges 1*b* in the reel radial direction, and is held at a position (in the reel radial direction) of a distance (D shown in FIG. 3) from the wound surface on the outer circumference of the reel body 1*a* in the range of more than 0 mm to 30 mm or less.

The support arm 3 is supported by the support block 4, and the support position is movable toward or away from a reel axis R with respect to the support block 4 by operating an adjusting handle 12.

The support block 4 is placed on a movable mount 11 that is movable along a linear guide rail (not shown) formed on a base (not shown) in a direction perpendicular to the reel axis direction (direction forward or backward with respect to the reel body 1*a*) using an air cylinder (not shown) for horizontal movement as the drive source. The support block 4 is thus movable, and by the movement of the support block 4 together with the movable mount 11 in the direction forward or backward with respect to the reel body 1*a*, the guide roller 2 moves in a direction in which the roller outer edge comes close to or goes away from the reel body 1*a* in the reel radial direction on the side near the reel 1.

The support block 4 is rotatable on the movable mount 11 along R guides (arc-shaped guide rails) 8 around the center of curvature of the R guides 8 as the rotation center using a servomotor 9 as the drive source. When the support block 4 rotates, the guide roller 2 inclines relative to the center of curvature of the R guides 8 as the rotation center C from the position (shown by the solid line in FIG. 1) perpendicular to the reel axis direction (up/down direction as viewed in FIG.

1) to either position (shown by the dashed-two dotted line in FIG. 1) inclined in the reel axis direction.

The positional relationship between the guide roller 2 and the rotation center C (the center of curvature of the R guides 8) can be adjusted by the operation of the adjusting handle 12. By turning the adjusting handle 12 to move the support position of the support arm 3 on the support block 4, the position of the support arm 3 with respect to the center of curvature of the R guides 8 changes, and thus the position of the guide roller 2 supported by the support arm 3, i.e., the positional relationship between the guide roller 2 and the rotation center C changes.

In this traverse device, while the reel 1 is moved in the reel axis direction (up/down direction in FIG. 1) thereby moving (traversing) the winding position of a wire T fed via the guide roller 2 with respect to the reel 1 in the reel axis direction at a pitch of regular winding, the reel 1 is rotated to wind the wire T onto the reel body 1*a*. Every time the wire T is wound by one layer, the movable mount 11 is moved to move the guide roller 2 in a direction away from the reel body 1*a* by the thickness of one layer of the wire T. The traverse direction is then reversed, to repeat the winding. In the course of the traverse, at a position apart from the borders with the reel flanges 1*b* (a position in the reel axis direction), the guide roller 2 is kept at an orientation where a roller radial center line P that crosses the reel axis R is perpendicular to the reel axis R. At a position of either of the borders with the reel flanges 1*b*, as the reel 1 moves in the reel axis direction, the guide roller 2 is gradually inclined in a direction in which the roller outer edge goes away from the reel flange 1*b* ahead in the traverse direction on the side apart from the reel body 1*a* relative to the rotation center C, as the fulcrum, located near the roller outer edge on the side near the outer circumference of the body of the reel 1.

The rotation center C is set in the vicinity of the roller outer edge on the side near the outer circumference of the body of the reel 1, for example, using, as the reference, the center position in the width direction of the bottom surface of the guide groove 2*a* on the outer circumference of the guide roller 2 on the side near the reel axis R. The position of the rotation center C can be moved by the operation of the adjusting handle 12, and is adjustable according to the thickness of the wire to be wound, etc.

Figure 3:
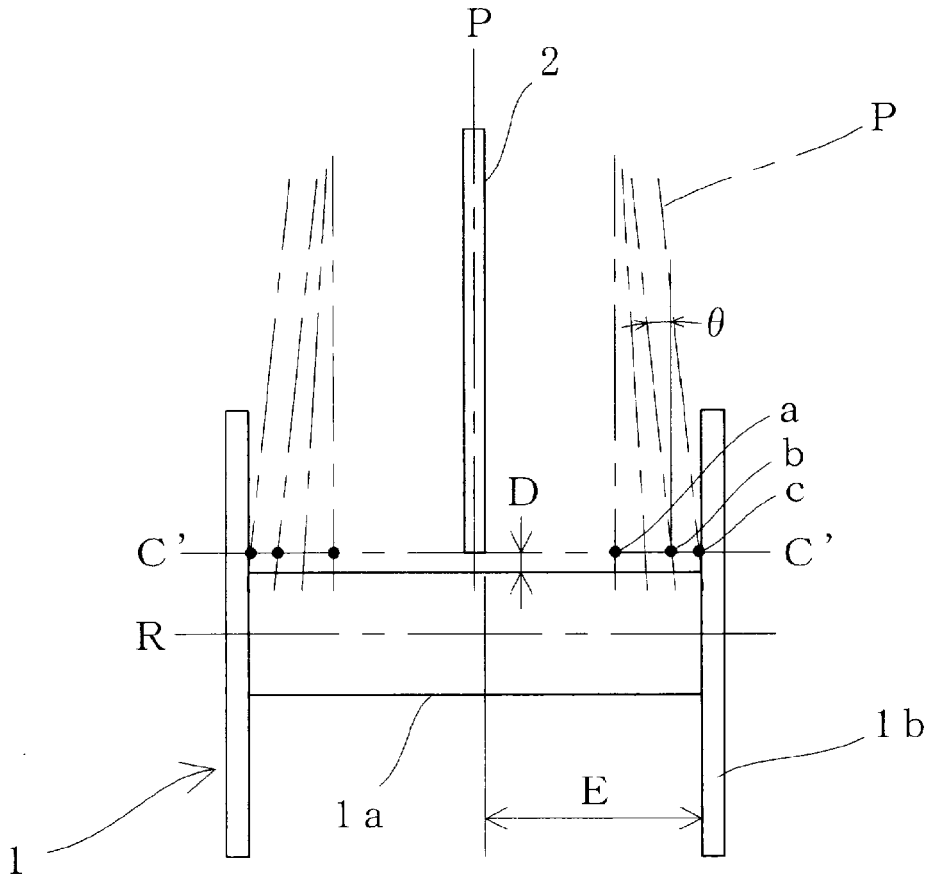
FIG. 3 is a schematic view explaining the operation of a guide roller in the traverse device of the embodiment of the invention.

The operation of the guide roller 2 will be described in more detail with reference to FIG. 3. Note that, in this embodiment, since the reel 1 moves, the guide roller 2 relatively moves with respect to the reel 1 in the reel axis direction, not actually moving in the reel axis direction. In FIG. 3, however, for convenience of explanation, the relative movement is shown by the movement of the guide roller 2. In FIG. 3, also, C'-C' represents a track of the movement of the rotation center C along with the movement of the guide roller 2 in the reel axis direction, where a, b, and c indicate positions of the rotation center C when the guide roller 2 is positioned at various points in the reel axis direction.

The outer edge of the guide roller 2 enters deep inside the reel flanges 1*b* in the reel radial direction and keeps a position (in the reel radial direction) of a distance (D shown in FIG. 3) from the wound surface on the outer circumference of the reel body 1*a* in the range of more than 0 mm to 30 mm or less. While keeping this distance, the guide roller 2 relatively moves with respect to the reel 1 in the reel axis direction as the reel 1 moves. At a position apart from each of the borders with the reel flanges 1*b* where the distance between a roller end face 2*b* and the reel flange 1*b* exceeds a given distance in the range of 10 to 50 mm (first distance) in the reel axis direction (a position inward in the reel axis direction from the position where the rotation center C is at point a in FIG. 3), the guide roller 2 keeps its orientation of the roller radial center line P being perpendicular to the reel axis R, and the wire T is wound in this state.

When the guide roller 2 comes close to the reel flange 1*b* and reaches the position where the distance between the roller end face 2*b* and the reel flange 1*b* is the first distance in the range of 10 to 50 mm (e.g., 35 mm) (the position where the rotation center C is at point a in FIG. 3), on the side closer to the reel flange 1*b* than this position, the guide roller 2 is gradually inclined in a direction in which the roller outer edge goes away from the reel flange 1*b* ahead in the traverse direction on the side apart from the reel body 1*a* relative to the rotation center C on the C'-C' line as the fulcrum as the guide roller 2 is closer to the reel flange 1*b*, until the guide roller 2 reaches a position where the distance between the roller end face 2*b* and the reel flange 1*b* is a second distance in the range of 1 to 10 mm (e.g., 5 mm) that is smaller than the first direction (e.g., 35 mm) in the reel axis direction (the position where the rotation center C is at point b in FIG. 3). The wire T is wound while the guide roller 2 is inclined in this way.

When the distance between the roller end face and the reel flange 1*b* reaches the second distance (e.g., 5 mm) described above (the position where the rotation center C is at point b in FIG. 3), the inclined angle θ of the roller radial center line P with respect to the direction perpendicular to the reel axis line R becomes the maximum that is in the range of 1 to 30°.

When the guide roller 2 passes beyond the position where the distance between the roller end face 2*b* and the reel flange 1*b* is the second distance (e.g., 5 mm) (the position where the rotation center C is at point b in FIG. 3) and reaches the traverse reversal position (the position where the rotation center C is at point c in FIG. 3), the guide roller 2 is stopped and then the movement in the reel axis direction is reversed. After the reversal, the wire T is wound in the opposite direction while the inclined angle is gradually reduced from the second position toward the first position.

If the inclined angle θ of the guide roller 2 near the traverse reversal position (the position where the rotation center C is at point c in FIG. 3) is less than 1°, winding of the wire up to both ends of the reel body 1*a* will be difficult, and also, if deformation of the reel 1 is large, there will be a possibility of collision. If the inclined angle θ of the guide roller 2 near the traverse reversal position (the position where the rotation center C is at point c in FIG. 3) exceeds 30°, the wire tends to come off the guide roller 2, and also the wire shape may be worsened. Moreover, a flaw may occur on the wire due to contact with the guide groove 2*a*. It is therefore advisable that the inclined angle θ be 1 to 30°.

In this traverse device, by the operation described above, the distance between the wound surface on the reel 1 and the guide roller 2 can be reduced over the entire area in the reel axis direction including the borders with the reel flanges 1*b*, permitting accurate control of the wound surface. Also, even if there are variations in machining precision, deformation due to repeated use, deformation at the time of heat treatment of the wire, etc. in the reel flanges 1*b*, the guide roller 2 is kept from contact with the reel flanges 1*b*, and thus occurrence of entanglement and flaws due to stacking of the wire T can be prevented. Thus, regular winding can be performed easily, inexpensively, and reliably.

The traverse device of this embodiment is suitable for regular winding of metal wires such as steel cords, bead wires, and wires for piston rings, coated wires such as electric cables, and other wires such as ropes. Not only round wires but also square wires and other oddly-formed wires such as I-shaped wires can be subjected to regular winding easily, inexpensively, and reliably.

Figure 4:
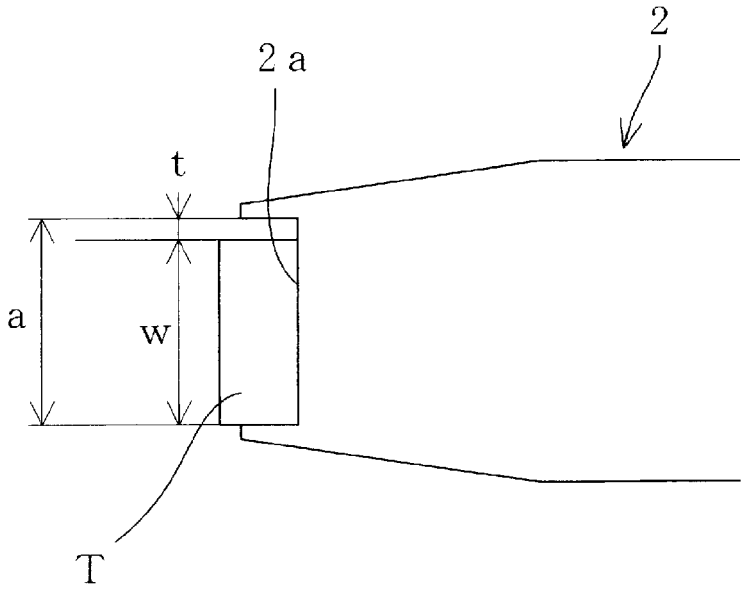
FIG. 4 is a cross-sectional view showing in an enlarged manner a portion of a guide groove on the outer circumference of the guide roller in the traverse device of the embodiment of the invention.

It is advisable that the width size (a shown in FIG. 4) of the guide groove 2*a* of the guide roller 2 be larger than the width size (W shown in FIG. 4) of the wire T by 0.1 to 0.50 mm. Having such a width size of the guide groove 2*a*, it is possible to prevent deviation of the wire T while securing leeway (t shown in FIG. 4) in the groove width direction. Thus, through accurate control of the winding position, regular winding as intended can be performed.

While the case of moving the reel 1 to perform the traverse was described in the above embodiment, the reel 1 may not be moved but the guide roller 2 may be moved in the reel axis direction, or both the reel 1 and the guide roller 2 may be moved to perform the traverse.

REFERENCE SIGNS LIST

1 Reel
1*a* Reel body
1*b* Reel flange
2 Guide roller
2*a* Guide groove
2*b* Roller end face
C Rotation center
T Wire
K Roller axis
P Roller radial center line
R Reel axis

The invention claimed is:

1. A traverse device for winding a wire onto a reel, the reel comprising a reel body extending along in a reel axis and first and second flanges, one on either end of the reel body, the device comprising:

a guide roller having a guide groove on an outer circumference, the wire material being fed through the guide groove from a position on a side of the guide roller opposite to the reel body to a winding position at the reel body when the device is in use, wherein the winding position is a position along the traverse direction of the reel, and wherein the guide roller is configured and connected to be gradually inclined during traverse in which the guide roller and the reel body are moved with respect to one another when in use, a driving source configured and operably connected to move the winding position of the wire with respect to the reel in a reel axis direction by moving the guide roller and the reel body with respect to one another, wherein the guide roller is configured to be placed near an outer circumference of a body of the reel, and is configured to be kept at an orientation where a roller radial center line crossing a reel axis is perpendicular to the reel axis at a position spaced apart from a reel flange border, and inclined in a direction in which a roller outer edge faces away from a reel flange ahead in a traverse direction on the side apart from the reel body relative to a rotation center forming a fulcrum about which the guide roller inclines when in use, the rotation center being located near the outer edge on the side near the outer circumference of the reel body at a position of the reel flange border.

2. The traverse device of claim 1, wherein the distance between the roller outer edge and the outer circumference of the reel body is in a range of more than 0 mm to 30 mm or less.

3. The traverse device of claim 1, wherein the width size of the guide groove of the guide roller is the width size of the wire plus 0.1 to 0.50 mm.

4. A traverse method using the traverse device of claim 1, comprising placing the guide roller near an outer circumference of a body of the reel, and keeping the guide roller at an orientation where a roller radial center line crossing a reel axis is perpendicular to the reel axis at a position apart from a reel flange border, and inclining the guide roller in a direction in which a roller outer edge goes away from a reel flange ahead in a traverse direction on the side apart from the reel body relative to a rotation center, as a fulcrum, located near the outer edge on the side near the outer circumference of the reel body at a position of the reel flange border.

5. A traverse device for winding a wire onto a reel, the reel comprising a reel body extending along in a reel axis and first and second flanges, one on either end of the reel body, the device comprising:

a guide roller having a guide groove on an outer circumference, the wire material being fed through the guide groove from a position on a side of the guide roller opposite to the reel body to a winding position at the reel body when the device is in use, wherein the winding position is a position along the traverse direction of the reel, and when in use, the guide roller is gradually inclined during traverse in which the guide roller and the reel body are moved with respect to one another, a driving source configured and operably connected to move the winding position of the wire with respect to the reel in a reel axis direction by moving the guide roller and the reel body with respect to one another, wherein the guide roller is configured to be placed near an outer circumference of a body of the reel, and is configured to be kept at an orientation where a roller radial center line crossing a reel axis is perpendicular to the reel axis at a position where the distance between a roller end face and a reel flange exceeds a first distance in the reel axis direction, and gradually inclined, with the movement in the reel axis direction, in a direction in which a roller outer edge faces away from a reel flange ahead in a traverse direction on the side apart from the reel body relative to a rotation center forming a fulcrum about which the guide roller inclines when in use, the rotation center being located near the outer edge on the side near the outer circumference of the reel body at a position where the distance between the roller end face and the reel flange does not exceed the first distance in the reel axis direction, so that the inclined angle of the roller radial center line to a direction perpendicular to the reel axis is at a maximum at a position where the distance between the roller end face and the reel flange is a second distance that is smaller than the first distance in the reel axis direction.

6. The traverse device of claim 5, wherein the first distance is 10 to 50 mm, and the second distance is 1 to 10 mm.

* * * * *